United States Patent [19]

Sklenak et al.

[11] Patent Number: 5,075,526

[45] Date of Patent: Dec. 24, 1991

[54] DISPOSABLE MICROWAVE PACKAGE HAVING ABSORBER BONDED TO MESH

[75] Inventors: John S. Sklenak, Sudbury; Sol Aisenberg, Natick; Kenneth W. Dudley, Sudbury; Robert J. Castoldi, Auburndale, all of Mass.

[73] Assignee: Raytheon Company, Lexington, Mass.

[21] Appl. No.: 300,448

[22] Filed: Jan. 23, 1989

[51] Int. Cl.[5] ..... H05B 6/80

[52] U.S. Cl. ..... 219/10.55 E; 219/10.55 F; 426/107; 426/234; 426/243; 99/DIG. 14

[58] Field of Search ..... 219/10.55 E, 10.55 F, 219/10.55 M, 10.55 R; 99/451, DIG. 14; 126/390; 426/107, 109, 111-114, 241, 243, 234

[56] References Cited

U.S. PATENT DOCUMENTS

| | | | |
|---|---|---|---|
| 3,302,632 | 12/1963 | Fichtner | 219/10.55 E X |
| 3,662,141 | 5/1972 | Freedman et al. | 219/10.55 E |
| 3,701,872 | 10/1972 | Levinson | 219/10.55 E |
| 3,946,187 | 3/1976 | MacMaster et al. | 219/10.55 E |
| 4,190,757 | 2/1980 | Turpin et al. | 219/10.55 E |
| 4,713,510 | 12/1987 | Quick et al. | 219/10.55 E |
| 4,742,203 | 5/1988 | Brown et al. | 219/10.55 E |
| 4,777,053 | 10/1988 | Tobelmann et al. | 426/107 |
| 4,927,991 | 5/1990 | Wendt et al. | 219/10.55 E |

*Primary Examiner*—Philip H. Leung

*Attorney, Agent, or Firm*—William R. Clark; Richard M. Sharkansky

[57] ABSTRACT

A microwave heating susceptor for browning or searing packaged foods in a microwave oven. The susceptor is constructed from a thin metal mesh, and a microwave absorbing material applied to the metal mesh. To sear food, the suspceptor is placed in proximity to food in a microwave oven cavity. When the microwave oven is turned on, the susceptor heats to a high temperature, thereby browning and cooking the food.

28 Claims, 2 Drawing Sheets

DISPOSABLE MICROWAVE PACKAGE HAVING ABSORBER BONDED TO MESH

Background of the Invention

This invention relates to a heating device for use in a microwave oven cavity which absorbs microwave energy and thus produces a heated surface. More particularly, this invention relates to a heating device which is adapted for cooking food or heating other substances by heat transfer in a microwave oven through thermal energy transfer.

A conventional gas or electric oven is typically heated to a relatively hot temperature such as, for example, 300°-500° F. The surface of the food in the oven is subjected to these hot temperatures, and the heat gradually conducts into the food, heating its interior. As a result, the surface of the food is seared or dried out, giving food the browning and color characteristics that people are used to and prefer.

Cooking with a microwave oven heats food with an entirely different principle than a conventional gas or electric oven. In microwave cooking, the microwave energy penetrates into the interior of the food, and thus internal heating begins immediately rather than as a result of slow conduction from the external surface. Further, the food exterior cools faster than the food interior, resulting in the food interior becoming hotter than the food exterior.

In the usual microwave cooking, microwave heat energy is applied throughout the volume of the food and results in moisture being driven to the food surface. This results in a soggy texture on a breaded surface where a seared or browned surface is desirable. Even for non-breaded food, a seared or browned surface is frequently desired.

One prior art method of providing searing and browning on the surface of food in a microwave oven is to provide a utensil or appliance that is positioned in the microwave cavity and absorbs microwave energy, thereby becoming hot. The food is postured against the utensil so that the heat conducts from the utensil to the food, thereby browning the surface of the food. One such utensil is a browning dish. One drawback of the browning dish is that it is not readily adaptable for disposable packaging due to the relatively high manufacturing costs. Another drawback of the browning dish is that it may have to be preheated to rise to a temperature sufficient to sear the surface of food. A further drawback of the browning dish when used in disposable packing is that it may have to contain a significant amount of mass which can add weight to the packaging.

Another microwave heating package is the one described in U. S. Pat. No. 4,190,757 to Turpin, et al. This patent describes the use of ferrite ceramic on a metal sheet. The ferrite is disposed within a binder to make a microwave absorbing material. The absorbing material is then applied to the metal sheet in a thin, paint-like layer so that the package acts as an active microwave absorber. When the Turpin package is placed in a microwave field, the temperature of the package becomes higher than that of the food, thereby searing any food the package contacts. One drawback of this package design as described in U.S. Pat. No. 4,190,757 is that ferrite particles of different sizes should be used in the absorbing material to minimize cracking or other damage to the package during cooking. Another drawback is that steam from the heated food may become trapped between the food and metal sheet, resulting in moisture collecting on the surface of the food.

Still another disadvantage is that the absorbing material may lose its adherence to the metal sheet. The microwave absorbing material and metal expand when heated. However, metal expands at a different rate than the absorbing material. When the absorbing material is applied to metal sheet and then heated, sheer forces may develop on the interface between the metal sheet and the absorbing material. These sheer forces may cause the absorbing material to lose adherence and flake off the metal sheet.

Summary of the Invention

It is an object of this invention to provide an improved package for heating of food in a microwave oven.

It is another object of this invention to provide a package for heating food in a microwave oven which has an improved temperature performance over the prior art.

It is another object of this invention to provide a microwave package for heating food in a microwave oven which contains a mesh for better adherence of a binder which contains ferrite.

It is also an object of this invention to provide a package which has a longer life expectancy by being able to withstand higher sheer forces and stress from heating.

It is also an object of this invention to provide a low cost package for heating food in a microwave oven.

It is an additional object of this invention to provide a package for heating food in a microwave oven that contains holes for releasing steam to prevent build-up of moisture on the surface of the food in the microwave oven.

It is also an object of this invention to provide a package for heating food in a microwave oven that thermally communicates with the food to cause sear lines on the surface of the food.

It is further an object of the present invention to provide a device suitable for use in a food package that automatically absorbs microwave energy and increases the surface temperature of the food above its interior temperature.

It is further an object of this invention to provide a package for heating food such that the package temperature is prevented from becoming so high that it burns the surface of the food.

Another object of this invention is to provide a package for heating food having a metal heating package for heating food wherein the metal particles from the heating package are prevented from migrating into the food.

The invention defines a package for heating food in a microwave oven comprising a mesh having a metal surface and a plurality of perforations, a heat resistant binder material bonded to the mesh, and a plurality of particles of microwave lossy material dispersed within the binder material disposed adjacent the mesh. It may be preferable that the binder materials and particles are applied to the mesh so as to substantially fill the perforations. It may further be preferable that the perforations are filled to have an aperture to allow steam from the food to escape upward or downward when the package is placed above the food and the food is heated.

The invention may also be practiced with a package for heating and searing food in a microwave oven comprising a sheet of perforated metal and a non-lossy binder material containing a plurality of ferromagnetic oxide particles, the binder material being applied in a paint-like layer to the sides and the bottom side of the sheet, the binder material being substantially embedded within the perforations. It may be preferable that the particles are dispersed within the binder to as to form strips laterally along the sheet such that when the package contacts the food during heating, sear lines will form on the surface of the food.

The invention may further be practiced by the method of cooking food in a microwave oven comprising the steps of positioning the food on a package having a mesh containing a plurality of perforations, a heat resistant binder material bonded to the mesh between the perforations and a plurality of particles of microwave lossy material dispersed within the binder material, and exposing the package to microwave energy wherein heat is generated in the package by microwave energy absorption, the heat conducting to the food to sear the surface thereof. It may be preferable that the method further comprise the step of providing a plurality of vent holes within the package for removing steam from the surface of the food.

Description of the Preferred Embodiments

Figure 2:
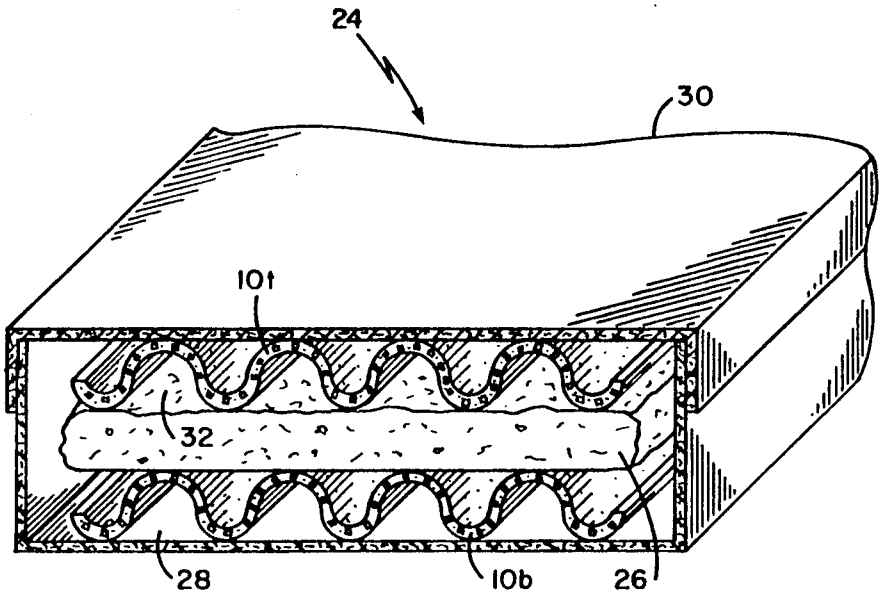
FIG. 2 shows a side sectional view of the microwave package heating the surface of food.
Figure 1:
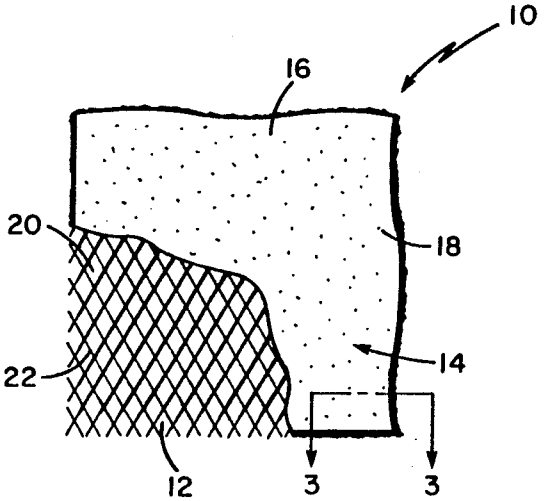
FIG. 1 shows a cutaway view of the microwave package with the mesh heat absorbing material exposed.
Figure 3:
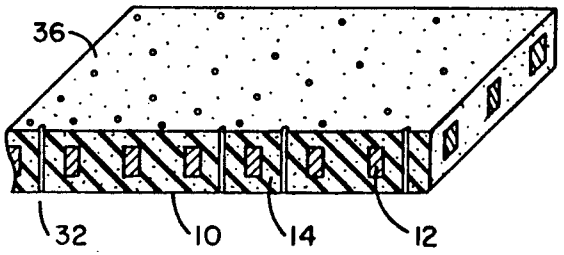
FIG. 3 is a side sectional view cut along line 3—3 of FIG. 1.

Referring to FIG. 1–FIG. 3, there is shown the preferred embodiments of the microwave heating package 10.

A home microwave oven (not shown) typically generates between 500 and 700 watts of microwave frequency radiation which heats the food in a microwave oven cavity. The microwave heating package 10 is placed in the cavity, contacting the food to be heated. The microwave heating package will absorb the microwave frequency radiation and become hot during microwave operation, heating the exterior surface of the food. Further, the microwave frequency radiation heats the interior of the food.

The microwave heating package 10 is constructed with metal mesh 12 coated with a heating layer of heat absorbing material 14. The heat absorbing material 14 is applied to one or both sides of the metal mesh 12. By applying the heat absorbing material to the mesh 12, migration of the metal particles from the mesh 12 into the food will be prevented. The heat absorbing material 14 comprises a composite of binder material 16 and lossy magnetic material 18. The metal mesh 12 shown has a plurality of substantially equally spaced diamond shaped perforations 20 separated by mesh webbing 22. The perforations are preferably diamond shaped; however, the perforations may be any shaped opening such as square, round, oval, triangular, etc. The metal mesh 12 and heat absorbing material 14 are preferably constructed from a flexible material to allow the microwave heating package 10 to bend. The mesh 12 may be constructed by being etched, stamped, perforated, and then expanded, fabricating by weaving or any other such method to construct a perforated sheet. The size of the microwave heating package 10 shown is approximately 4" by 4"; however, this size may be modified to cover the food to be cooked. Further, the microwave heating package 10 may be wrapped in a high temperature rated polyester or equivalent package (not shown) before being placed over the food to be cooked. The wrapping provides a sterilization layer between the microwave heating package and the item to be cooked.

Referring to FIG. 2, there is shown a heating container 24 having a top microwave heating package **10*t* and bottom microwave heating package 10*b* covering food 26 such as a fish patty. Food 26 and microwave heating packages 10*t* and 10*b* are enclosed within an outer package 28 having a cover 30. This outer package 28 and cover 30 are preferably made from paper, plastic, or other material which can withstand high temperatures without damage. The outer package 28 and cover 30 can be constructed to absorb moisture, or have venting to further release moisture from food 26. The microwave heating packages 10*t* and 10*b*** shown are shaped in a corrugated-like fashion. The microwave heating package can also be formed to the shape of the food product, i.e. to approximate the contours of the food such as a chicken drumstick or an egg roll.

Heating container 24 is constructed by mounting or attaching bottom microwave heating package **10*b* to the floor of outer package 28. The food 26 is then placed over the bottom microwave heating package 10*b*. A top microwave heating package 10*t* may be then placed over the food 26. Cover 30 may then be placed on package 28 to seal heating container 24 for storage and transport. The top microwave heating package 10*t* may be attached to cover 30** to prevent movement during transport.

During operation, the container 24 is then placed in a microwave oven. The cover may be removed. When the food 26 is heated with the microwave heating packages **10*t* and 10*b* in a microwave oven cavity, the microwave heating packages 10*t* and 10*b* will become hot. As the food 26 cooks, sear lines will develop on the food 26 at the areas where the microwave heating packages 10*t* and 10*b* contact food 26. It may be preferable that the locations where the microwave heating packages 10*t* and 10*b* contact the food 26 have a thicker layer of the heat absorbing material 14. If food 26 does not contact microwave heating package 10*t*, the food 26 will still be heated by microwave heating package 10*t* by radiation. By adjusting the amount of lossy material 18 on the microwave heating package 10*t* and 10*b*, the temperature of the surface of the food 26 adjacent the microwave heating packages 10*t* and 10*b* can be regulated. By corrugating the top microwave heating packages 10*t* and 10*b*, steam 32 is allowed to escape from the food 26, causing the surface of the food 26 to become crispy. Further, by corrugating the bottom microwave heating package 10*b*, the drippings from the food 26 will drain, resulting in the cooked food 26** having a less soggy texture.

Referring to FIG. 3, there is shown a sectioned view of the microwave heating package 10 in FIG. 1. Scattered throughout the microwave heating package 10 may be a plurality of ducts or apertures 36. These apertures 36 are disposed within the perforations 20 of the metal mesh 12 and provide a duct 36 in which steam 32 can escape through the microwave heating packages 10*t* or 10*b* as shown in FIG. 2. Duct 36 further enhances the crisping of the food 26 surface. The heat absorbing material 14 preferably fully encases the metal mesh 12, having a total composite thickness between 0.010 and 0.060 inches. The mesh 12 is preferably made from aluminum; however, any metal material or metalized high temperature plastic that is non-lossy with good thermal characteristics may be used to construct a mesh 12. The metal mesh 12 may be coated with an additional thin layer of material (not shown), such as a high-temperature plastic, polyester or rubber to further prevent metal particles from the metal mesh 12 from migrating into the food.

The heat absorbing material 14 may comprise a mixture of a binder 16 and a lossy magnetic material 18. The binder 16 may be made with silicone resin, silicone rubber or sodium silicate. The lossy magnetic material 18 may be comprised of materials such as ferrite ($Fe_3O_4$) or iron oxide. The approximate portions for the heat absorbing material 14 are 10–33% sodium silicate, 5–15% $H_2O$ and 65–80% $Fe_3O_4$. Other heat absorbing materials 14 may contain the following: DC595 (Type A and B) Silicone, sold by Dow Corning Corporation of Midland, Mich., may be used as a binder mixed with $Fe_3O_4$, such that the proportions are preferably two parts $Fe_3O_4$ to one part DC595. XYLAN 8778, sold by Whitford Corporation of Frazer, Pa., may be used as a heat absorbing material as it contains a binder and a lossy magnetic material. Tri-Plus, sold by General Electric Corporation of Waterford, New York, may be used as a sealing coating over the sodium silicate. Further, the heat absorbing materials described in U.S. Pat. No. 4,190,757 may be used and are hereby incorporated by reference.

The microwave heating package 10 may alternately be constructed with the lossy magnetic material being placed over the binder material and not in contact with the metal mesh. The microwave magnetic field induced on the metal mesh 12 during cooking will have a range greater than the thickness of the binder and will reach the lossy magnetic material.

The preferred binder 16 is made of a flexible material. A flexible material can be bent without fracturing once it has cured so that it will flex when applied to a metal sheet or metal mesh to reduce the chance of the heat absorbing material separating from the sheet or mesh during cooking.

Other preferred binder criteria include the following: First, the binder should adhere to metal. Second, the binder should be suitable for contact with food both at high and low temperatures. Third, the binder should be heat and temperature resistant to a minimum of 350° F. without damage. Fourth, the binder should prevent the metal particles from the metal mesh from migrating into the food.

One such binder that meets the preceeding criteria and is flexible is DC595 Silicone. One way to construct a microwave heating package using DC595 is as follows: One part DC595 (Type A) is mixed with an equal amount by weight of DC595 (Type B) and four parts by weight of ferrite to make a heat absorbing material. The heat absorbing material is then applied to the metal mesh by such methods as spraying or spreading. The additions of solvents such as Toluene may be necessary to formulate a sprayable mixture. The metal mesh and heat absorbing material is then heated above 230° F. to cause the DC595 heat absorbing material to cure. The microwave heating package is then allowed to cool. After cooling, the heat absorbing material is ready to use and will not dissolve in hot food grease, nor will DC595 separate from the metal mesh, thereby preventing heat absorbing particles from being absorbed into the food product.

Other alternatives to a binder material include either ceramic or an aluminum oxide. These materials can be bonded to the metal mesh by anodization in an electrolaytive solution, by plasma oxidation, by steam iodation, or by other oxidation methods.

To build a microwave heating package using other binder and lossy materials, the binder 16 is mixed with the lossy material 18 to make a heat absorbing material 14, if the binder is not already pre-mixed. The heat absorbing material 14 is then applied to the metal mesh. The heat absorbing material 14 may be applied by any method such as spreading or by spraying the heat absorbing material 14 on the metal mesh 12. The heat absorbing material 14 preferably applied to both sides of the metal mesh 12. It is preferable that the perforations 20 be substantially filled; however, the perforations may have openings when using a mesh with larger perforations. The heat absorbing material 14 is applied to the metal mesh 12 and preferably has an average weight of 0.1 to 1.0 grams per square inch. The preferred thickness of the metal mesh/heat absorbing material composite or microwave heating package 10 is between 0.010 and 0.060 inches. The preferable thickness of the metal mesh 12 is between 0.002 and 0.050 inches. It is preferred that metal mesh 12 will have perforations 20 having a width between 0.03 and 0.25 inches.

Heat absorbing material 14 should not lose its adherence to the metal mesh 12 when heated. When the microwave heating package 10 is heated, the metal mesh 12 expands by a small amount along the length (typically ⅛") of each of the mesh webbing 22. Further, the heat absorbing material 14 is attached at the intersection of the mesh webbing 22 which enhances the bonding of the heat absorbing material 14 to the metal mesh 12. Accordingly, the metal mesh 12 expands within the heat absorbing material 14, thereby preventing the heat absorbing material 14 from separating. Further, if the heat absorbing material 14 is flexible, it will expand (or elongate) with the mesh, further reducing the chance of separation.

Table I provides a listing of some possible binder material 16, lossy material 18, and their constituents and associated thickness for constructing a microwave heating package. All dimensions are given in inches unless otherwise specified. The metal mesh 12 and the heat absorbing material 14 may be selected to accommodate the particular application in which the microwave heating package 10 is used. The data for Table I below was taken with microwave heating package 10 in an Amana 700 W microwave oven. The microwave heating package 10 used had dimensions at 3.5"×3.5". The heat absorbing material was applied to both sides of an aluminum metal mesh 12 by spraying.

TABLE I

| Example | Matrix Weight | Mesh Thickness | Mesh Web Width | Mesh Diamond Size | Mesh Weight | Temp °C. after 25 Sec. | Matrix Composition | Binder |
|---|---|---|---|---|---|---|---|---|
| 1 | .24 gm/in$^2$ | .010 | .010 | .077 | 2 gm | 125–170 | 62.5% $Fe_3O_4$ 5% $H_2O$ | Sodium Silicate |
| 2 | .26 gm/in$^2$ | .005 | .010 | .125 | .4 gm | 165–183 | 62.5% $Fe_3O_4$ 5% $H_2O$ | Sodium Silicate |
| 3 | .26 gm/in$^2$ | .005 | .012 | .189 | .5 gm | 215–226 | 62.5% $Fe_3O_4$ 5% $H_2O$ | Sodium Silicate |
| 4 | .29 gm/in$^2$ | .010 | .012 | .289 | .9 gm | 157–192 | 62.5% $Fe_3O_4$ 5% $H_2O$ | |
| 5 | .25 gm/in$^2$ | .010 | .010 | .077 | 2 gm | 105–110 | $Fe_3O_4$ | XYLAN 8778 |
| 6 | .22 gm/in$^2$ | .010 | .010 | .077 | 2 gm | 105–110 | 67% $Fe_3O_4$ | DC595 |
| 7 | .22 gm/in$^2$ | .010 | .010 | .077 | 2 gm | 135–140 | 67% $Fe_3O_4$ | DC595 |

Figure 4:
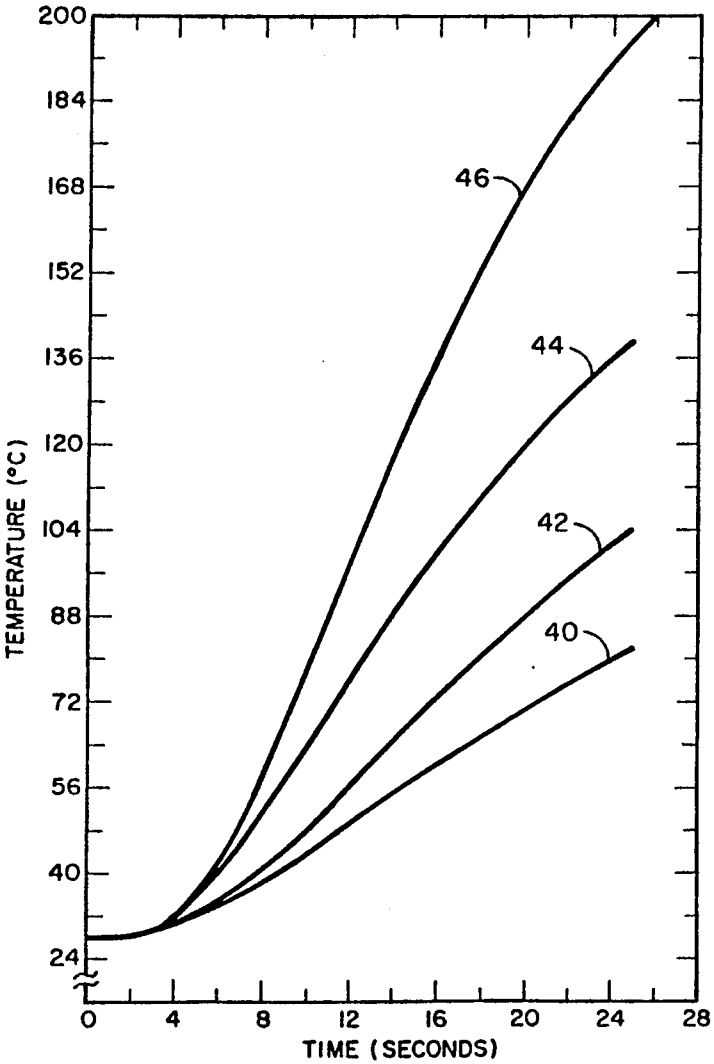
FIG. 4 is a graph showing the time/temperature response of the microwave package of different thicknesses.

Referring to FIG. 4, there is shown a chart demonstrating the time vs. temperature characteristics of the heat absorbing materials containing different amounts of ferrite.

All characteristics were measured in an Amana 700 Watt microwave oven using an aluminum mesh having dimensions 3.5"×3.5". The aluminum mesh also had a 0.077 inch mesh perforation size, 0.010 inch thickness, and a 0.010 inch mesh web width. Further, all aluminum meshes had a sodium silicate binder plus a 62.5%–80% $Fe_3O_4$ (ferrite) composition sprayed onto both sides of the aluminum mesh. Line 40 was measured using 2.7 grams of heat absorbing material with a 62.5% composition of $Fe_3O_4$. Line 42 was measured using 62.5% of $Fe_3O_4$ with 5.0 grams of heat absorbing material. Line 44 was measured using 62.5% $Fe_3O_4$ with 5.0 grams of heat absorbing material. Line 46 was measured using 80% of $Fe_3O_4$ with 4.9 grams of heat absorbing material. It can be seen from this chart that as the density and quantity of ferrite increases, the time for the microwave heating package to heat up is less. Accordingly, the amount of ferrite on the metal mesh can be varied in accordance with the food used and the microwave heating package required surface cooking temperature.

Figure 5:
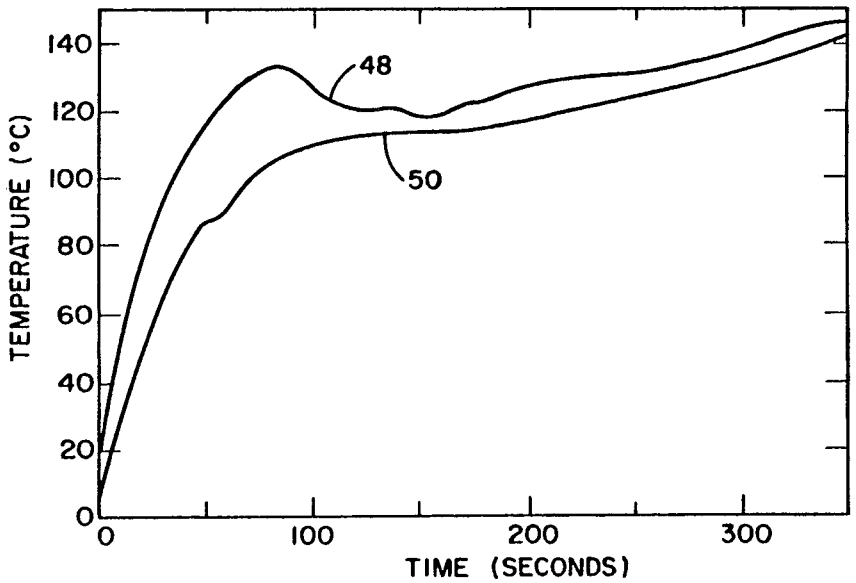
FIG. 5 is a graph showing the time/temperature response of the microwave package under a loaded condition.

Referring to FIG. 5, there is shown a chart showing the relationship of the heating package under a loaded condition, as seen in FIG. 2. In other words, this chart shows the time versus temperature characteristics for microwave heating packages 10*t* and 10*b* cooking a fish patty 26 in an Amana 700 watt microwave oven. The microwave heating packages 10*t* and 10*b* used had a dimension of 6.25 by 7.00 inches. The microwave heating packages 10*t* and 10*b* used were constructed with the materials having proportions shown in Example 1 of Table I. Line 48 represents the heating characteristics of the top microwave heating package 10*t* and line 50 shows the bottom microwave heating package 10*b*.

Having described preferred embodiments of this invention, it is now evident that other embodiments incorporating these concepts may be used. It is felt, therefore, that this invention should not be restricted to the disclosed embodiments, but should be limited only by the spirit and scope of the appended claims.

What is claimed is:

1. A package for heating food in a microwave oven comprising:

a mesh having a metal surface and plurality of perforations;

a heat-resistant binder material bonded to said mesh;

a plurality of particles of microwave lossy material dispersed within said binder material; and a plurality of apertures in said binder material, all of said plurality of apertures passing through said perforations.

2. The package as recited in claim 1 wherein said mesh is formed from a plurality of connected metal webbing, and wherein said binder material and particles are applied to said mesh so as to substantially fill the area between said webbing.

3. The package as recited in claim 1 wherein said particles and said binder material are bonded to both sides of said mesh.

4. The package as recited in claim 1 wherein said mesh is constructed from metal.

5. The package as recited in claim 1 wherein said particles comprise $Fe_3O_4$.

6. The package as recited in claim 1 wherein said perforations are separated by a distance of 0.005–1.25 inches.

7. The package as recited in claim 1 wherein said perforations have width of between 0.03 and 0.25 inches.

8. The package as recited in claim 1 wherein said binder material comprises a ceramic material.

9. The package as recited in claim 1 further comprising a heating container enclosing said food and said mesh.

10. A package for heating and searing food in a microwave oven comprising:

a sheet of metal having perforations, a top surface, and a bottom surface;

a non-loosy binder material containing a plurality of microwave lossy particles, said binder material being applied in a paint-like layer to the top surface and the bottom surface of said sheet, said binder material being substantially embedded within said perforations; and a plurality of apertures in said binder material passing through said perforations.

11. The package as recited in claim 10 wherein said perforations have a width of between 0.03 and 0.25 inches.

12. The package as recited in claim 9 wherein said perforations have a minimum spacing between 0.0005 and 0.125 inches.

13. The package as recited in claim 9 wherein said sheet of perforated metal has a thickness between 0.002 and 0.050 inches thick.

14. The package as recited in claim 12 wherein said sheet and binder have a total composite thickness between 0.010 and 0.060 inches thick.

15. The package as recited in claim 9 wherein said sheet is corrugated to cause sear lines in said food when said package contacts said food during heating.

16. The package as recited in claim 9 wherein said binder is disposed in strips laterally along the surface of said sheet such that when said package contacts said food during heating, sear lines will form on the surface of said food.

17. The package as recited in claim 10 wherein said binder is flexible so as to not separate from said perforated metal when heated.

18. The package as recited in claim 10 wherein said sheet is an aluminum mesh.

19. The package as recited in claim 10 wherein said binder material contains DC595.

20. The package as recited in claim 10 wherein said particles are disposed on the surface of said binder material apart from said metal sheet.

21. A method of cooking food in a microwave oven comprising the steps of:

positioning said food on a package having a mesh containing a plurality of perforations, a heat resistant binder material bonded to said mesh, a plurality of particles of microwave lossy material dispersed within said binder material, and a plurality of apertures in said binder material all of said plurality of apertures passing through said perforations; and exposing said package to microwave energy wherein heat is generated in said package by microwave energy absorption, said heat conducting from said binder material directly to said food to sear the surface thereof.

22. A package for heating food in a microwave oven comprising:

a sheet having a metal surface and having a plurality of perforations scattered throughout said sheet;

a heat-resistant binder material bonded to said sheet so as to substantially cover said metal surface;

a multiplicity of particles of lossy material dispersed within said binder material; and a plurality of apertures disposed in said binder material, all of said plurality of apertures passing through said perforations to allow steam from the food to vent through the apertures when the package is placed above the food and the food is heated.

23. A method of providing a microwave heating package comprising the steps of:

providing a mesh webbing having a plurality of perforations separated by said webbing and surrounded by a plurality of intersections of said webbing;

providing a heat absorbing material comprising a binder material and a microwave lossy material; and applying said heat absorbing material to said mesh webbing so that said heat absorbing material attaches to said mesh webbing at said plurality of intersections and openings are provided through said plurality of perforations.

24. The method recited in claim 23 wherein said heat absorbing material applying step comprises the step of spraying said heat absorbing material onto said mesh webbing.

25. The method recited in claim 23 wherein said heat absorbing material applying step comprises the step of spreading said heat absorbing material onto said mesh webbing.

26. A package for heating food in a microwave oven comprising:

a mesh webbing having a plurality of perforations separated by said webbing and surrounded by a plurality of intersections of said webbing;

a heat absorbing material comprising a binder material and a microwave lossy material, said heat absorbing material being applied to said mesh webbing so that openings are provided only through said plurality of perforations.

27. The package recited in claim 26 wherein said heat absorbing material is attached to said mesh webbing at said plurality of intersections.

28. A method of providing a microwave heat package comprising the steps of:

providing a mesh webbing having a plurality of perforations separated by said mesh webbing and surrounded by a plurality of intersections of said webbing;

providing a heat absorbing material comprising a binder material and a microwave lossy material; and applying the binder material to the mesh so that said plurality of perforations in the mesh remain open.

* * * * *